US006484795B1

(12) United States Patent
Kasprzyk

(10) Patent No.: US 6,484,795 B1
(45) Date of Patent: Nov. 26, 2002

(54) INSERT FOR A RADIANT TUBE

(76) Inventor: Martin R. Kasprzyk, 2648 Ransomville Rd., Ransomville, NY (US) 14131

( * ) Notice: Subject to any disclaimer, the term of this patent is extended or adjusted under 35 U.S.C. 154(b) by 84 days.

(21) Appl. No.: 09/658,143

(22) Filed: Sep. 8, 2000

Related U.S. Application Data

(60) Provisional application No. 60/153,306, filed on Sep. 10, 1999.

(51) Int. Cl.[7] ..... F28F 13/12; F28F 1/40

(52) U.S. Cl. ..... 165/109.1; 138/38; 428/371

(58) Field of Search ..... 428/592, 36.9, 428/371; 138/38; 165/109.1

(56) References Cited

U.S. PATENT DOCUMENTS 3,071,159 A * 1/1963 Coraggioso ..... 165/109.1

* cited by examiner

*Primary Examiner*—Alexander S. Thomas
(74) *Attorney, Agent, or Firm*—Greenwald & Basch LLP; Howard J. Greenwald

(57) ABSTRACT

An integral ceramic insert for a radiant tube. The insert has a helical shape and contains ceramic material; and it has a thermal expansion rate of less than $6.0\times10^{-6}$ meters/meter/degree Celsius and a thermal conductivity of at least 0.2 calories/centimeter/second/degree Celsius. The diameter of the insert is from about 2 to about 10 inches, and it has a length such that the ratio of its length to its diameter is from about 2/1 to about 8/1. The helical shape of the insert contains one or more pitches of from about 2 to about 32 inches, each which defines a helix angle of from about 15 to about 80 degrees.

15 Claims, 6 Drawing Sheets

INSERT FOR A RADIANT TUBE

CROSS-REFERENCE TO RELATED PATENT APPLICATION

This patent application claims priority based upon applicant's provisional patent application 60/153,306, filed on Sep. 10, 1999.

FIELD OF THE INVENTION

An insert for a radiant tube which consists essentially of ceramic material with a specified rate of thermal expansion and a specified thermal conductivity, wherein the insert is the shape of a helix with a specified number of turns per unit of length and per unit diameter and a specified number of cross-sectional wings.

BACKGROUND OF THE INVENTION

Many industrial process furnaces require special atmospheres and, thus, cannot be directly heated by means of gas combustion. These special atmosphere furnaces are often heated by means of a system in which gas-air combustion takes place within long metal alloy tubes which exit to the outside of the furnace wall to prevent contamination of the furnace's atmosphere. These furnaces are primarily heated by radiation coming off of the tubes; thus these tubes are called "radiant tubes."

Such "radiant tubes" are well known to those skilled in the art and are described, e.g., in applicant's U.S. Pat. Nos. 5,655,599, 5,071,685, and 4,789,506; the disclosure of each of these United States patents is hereby incorporated by reference into this specification.

The radiant tubes sometimes contain "inserts" to increase heat transfer from the combustion gases to the inside surface of the radiant tube. Thus, by way of illustration, U.S. Pat. No. 4,869,230 describes a "turbulator insert" in a radiant tube which is formed as a corrugated strip of metal alloy material (such as nickel-chromium alloy or iron-nickel-chromium alloy material) twisted to form a helix; the entire disclosure of this United States patent is hereby incorporated by reference into this specification.

Such metal alloy material inserts, while initially effective, are not very durable. Thus, some work has been done to replace these metal alloy material inserts with ceramic inserts. Illustrative of such work is the "FLAME BUSTER" ceramic inserts sold by Ipsen Industries, Inc. of Rockford, Ill. in the 1950's. These inserts met with only limited commercial success, primarily because they would tend to break while in use and often damage the burner assemblies. By way of further illustration, reference may be had to the heat exchanger baffle system disclosed in U.S. Pat. No. 2,861,596 of Ipsen, the entire disclosure of which is hereby incorporated by reference into this specification; it is believed that the insert described in this patent is similar to such "FLAME BUSTER" insert.

These ceramic inserts were discussed in U.S. Pat. No. 4,153,035 of Carl-Heinz Stiasny, wherein it is disclosed that "Such flame breakers may be made of ceramic material. With a design of this type, heat losses . . . may be relatively high . . . . Furthermore, flame breakers of this type . . . involve the risk of breakage particularly where vibrations in the furnace occur . . . "

The Stiasny patent issued in 1979. Since that time, to the best of applicant's knowledge, no flame breaker has been described in the prior art which is made of ceramic material, which has a substantially helical shape, and which provides efficient heat transfer and consequent low energy consumption and, additionally, is durable.

SUMMARY OF THE INVENTION

It is an object of this invention to provide a flame breaker with a substantially helical shape which consists essentially of ceramic material, and which has a thermal expansion of less than $6\times10^{-6}$ meter/meter/degree Celsius, which has a thermal conductivity of greater than 30 watts/meters/degree Celsius.

BRIEF DESCRIPTION OF THE DRAWINGS

The claimed invention will be described by reference to the following drawings, in which like numerals refer to like elements, and in which:

DESCRIPTION OF THE PREFERRED EMBODIMENTS

Figure 1:
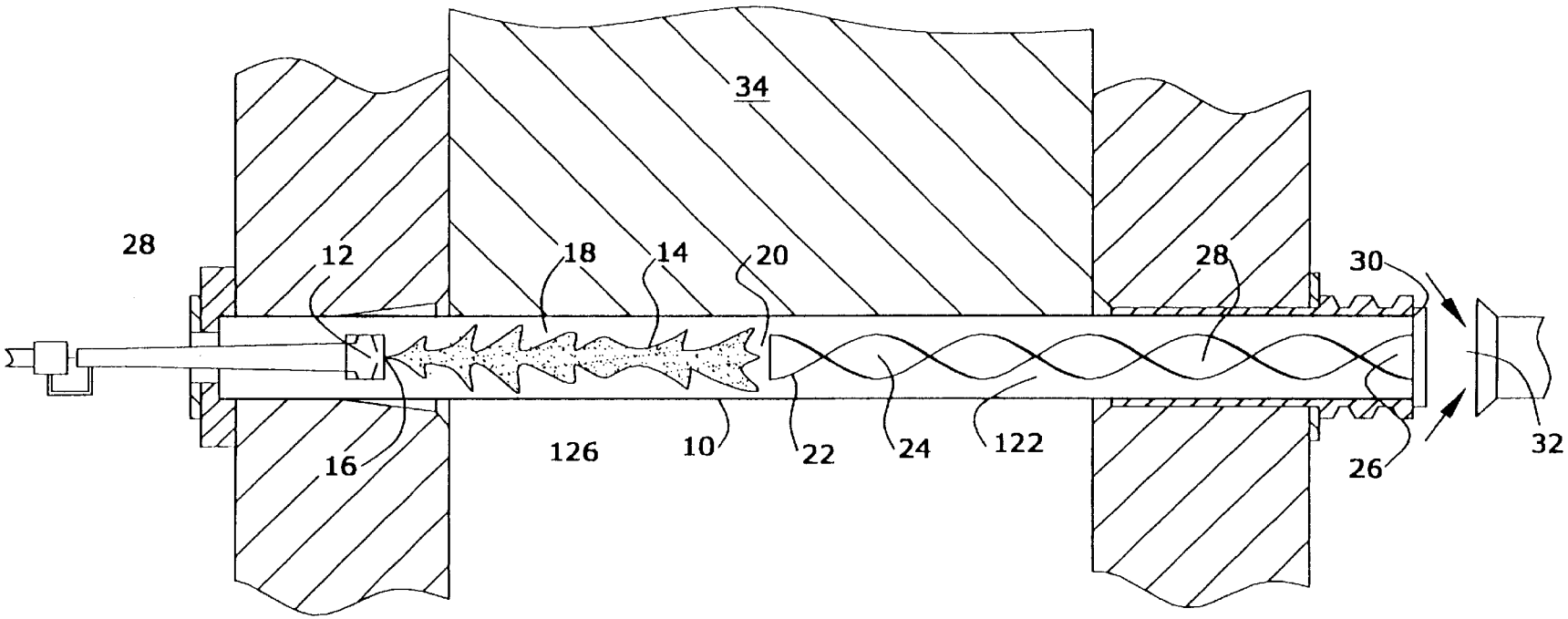
FIG. 1 is a sectional view of a radiant tube assembly comprised of a burner and a flame buster.

The insert of this invention is a ceramic material which has resistance to thermal shock. In general, such material will have a combination of low thermal expansion rate and high thermal conductivity properties.

As used herein, the term "ceramic" includes an inorganic material (such as silicon nitride, silicon carbide), used either by itself or with an infiltrant. Thus, as used in this specification, a body consisting essentially of silicon carbide is "ceramic." Additionally, a body which consists of a porous silicon carbide body infiltrated with infiltrant such as molten silicon also is "ceramic." Additionally, a mixture of silicon carbide particles and either graphite and/or amorphous carbon particles may be used to prepare a "ceramic." It is preferred that at least about 40 volume percent of the final material be comprised of either silicon carbide.

The thermal expansion rate of the ceramic material generally is less than $6.0\times10^{-6}$ meter/meter degree Celsius and, preferably, less than $4.5\times10^{-6}$ meter/meter degree Celsius.

The thermal conductivity of the ceramic material varies with temperature. At a temperature of 25 degrees Celsius, the thermal conductivity of the ceramic material is at least about 0.2 (and preferably at least about 0.3) calories/centimeter/second/degree Celsius. At a temperature of 1,200 degrees Celsius, the thermal conductivity of the ceramic material is at least about 0.05 (and preferably at least about 0.08) calories/centimeter/ second/degree Celsius.

In general the thermal expansion rate and the thermal conductivity of the ceramic material should be comparable to the properties of silicon carbide or silicon nitride.

The ceramic material preferably is substantially oxidation resistant in the combustion flame environment.

The ceramic material preferably is also creep resistant. When the ceramic material is heated to a temperature of at least about 1,400 degrees Celsius for at least about 5 years, it will not change its shape under its own weight.

In one preferred embodiment, the ceramic material is silicon carbide. In another preferred embodiment, the ceramic material is silicon nitride.

One may also use mixtures of ceramic materials which provide the required properties. Thus, by way of illustration and not limitation, one may use one or more of the materials disclosed in U.S. Pat. No. 5,523,133, the entire disclosure of which is hereby incorporated by reference into this specification. Thus, one may use materials comprised of a silicon carbide matrix with ceramic oxide fiber reinforcements.

The ceramic insert of this invention may be comprised of a plurality of strips, each twisted longitudinally to define between its opposite end portions helical passages on opposite sides of each strip, wherein each of said strips are of a substantially uniform width; see, e.g., U.S. Pat. No. 5,523,133.

By way of further illustration, the ceramic insert of this invention may be a three-, four-, and/or six-leaf radiating surface tube insert, as is disclosed in U.S. Pat. No. 3,886,976 of Kardas et al., the entire disclosure of which is hereby incorporated by reference into this specification. In one aspect of this embodiment, the insert is the in the shape of a five-leaf cruciform; see, e.g., U.S. Pat. No. 2,895,508 of Drake, the entire disclosure of which is hereby incorporated by reference into this specification. In another aspect of this embodiment, the insert may be in the shape of a spiral cruciform with notched edges; see, e.g., U.S. Pat. No. 3,394,736 of Pearson, the entire disclosure of which is hereby incorporated by reference into this specification.

In one embodiment, the ceramic insert has a cross sectional shape defined by a lateral portion inclined at right angles with respect to and on either side of a central portion. In another embodiment, the ceramic insert has a cross-sectional shape defined by lateral portions having a profile which is curved inwardly toward a plane N that is normal to the center portion. In yet another embodiment, the ceramic insert has a cross sectional shape defined by a central portion having double S-shaped curvature. These shapes are disclosed on page 104 of Topical Technical Report GRI 91-0146, published June, 1991 by the Gas Research Institute of Chicago, Ill.; and they are also disclosed in U.S. Pat. No. 4,700,749, the entire disclosure of which is hereby incorporated by reference into this specification.

The ceramic insert may be in the shape of a swirl flow device, such as one or more of the swirl flow devices disclosed in U.S. Pat. Nos. 1,770,208, 1,916,337, 2,097,104, 2,161,887, 3,071,159, 3,407,871, 3,783,938, 3,870081, 4,044,796, 4,090,559, 4,336,883, 4,559,998, 4,700,749, 4,823,865, and the like. The entire disclosure of each of these United States patents is hereby incorporated by reference into this specification.

FIG. 1 is a schematic representation of a radiant tube 10. Referring to FIG. 1, it will be seen that air and gas are fed into such tube through burner tip 12, creating an area of advancing flame 14. As the combustion process, continues, the mixture within tube 10 changes. Thus, at point 16, the mixture within tube 10 primarily contains gas and air. At point 18, the mixture within tube 10 contains gas, air, and combustion products. At point 20, combustion is complete, and normally all of the fuel has been consumed. It will be apparent to those skilled in the art that the temperature at points 16, 18, and 20 will differ.

Referring again to FIG. 1, at point 22, the mixture within tube 10 first contacts helical ceramic insert 24, and it exchanges heat with such insert. The temperature at point 22 will differ from the temperatures at points 26 and 28.

In general, it would be desirable to have the outer surface of tube 1 exhibit the same temperature from end 28 to end 30 and, preferably, have the temperature of the exit gas at point 32 be no higher that the temperature of furnace 34. Such an ideal condition assures uniform furnace heating and maximizes the efficiency of the heat transfer.

In order to approach this ideal condition, applicant has designed a series of novel radiant tube assemblies. The first of these assemblies is illustrated in FIG. 2.

Figure 2:
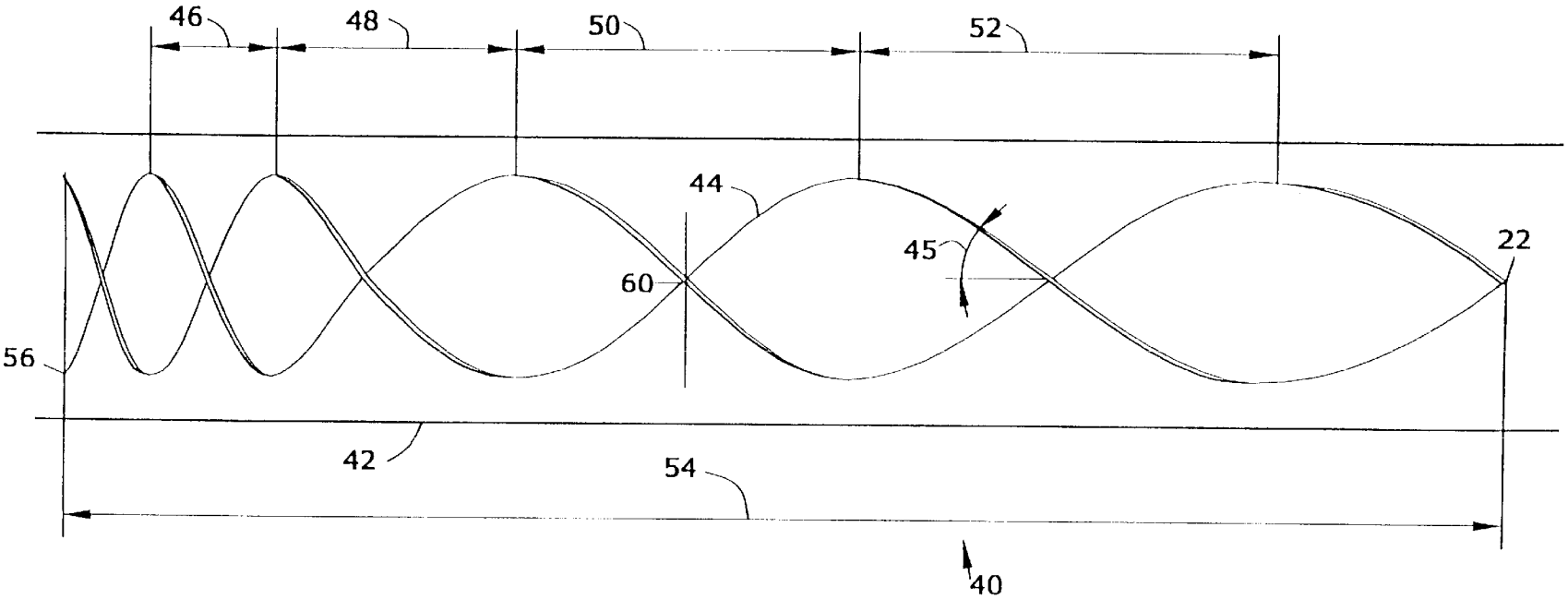
FIG. 2 is a side view of one preferred flame buster of the invention.

Referring to FIG. 2, it will be seen that radiant tube assembly 40 is comprised of a radiant tube 42 and disposed therein a variable pitch helical ceramic insert 44. As is known to those skilled in the art, pitch refers to the distance between two adjacent turns of the helices. Thus, in this variable pitch insert 44, pitch 46, pitch 48, pitch 50, and pitch 52 are not necessarily all equal to each other. In one embodiment, illustrated in FIG. 2, each of pitches 46, 48, 50, and 52 differ from each other.

Although FIG. 2 illustrates a helical insert 44 with 5 helical sections, it will be apparent that helices with fewer or more sections may be used.

In the general, the helical insert 24 will have a length such that the ratio of its length to its diameter is from about 1/1 to about 15/1, and preferably from about 2/1 to about 8/1. The diameter of helical insert 44 is from about 2 to about 10 inches.

The pitches used in helical insert 44 range from about 2 to about 32 inches; The pitch of the helical insert 44 divided by the diameter of the insert will determine the helix angle 45 (see FIG. 2). In general, for the preferred helical insert 44, the helix angle 45 will range from about 15 to about 80 degrees and, preferably from about 40 to about 80 degrees, and more preferably from about 60 to about 80 degrees.

In general, the pitches used in helical insert 44 range from about 0.5 to about 8 inches of pitch per inch of diameter of the helical insert.

In the preferred embodiment depicted in FIG. 2, the pitch at the point 22 of the insert 44 nearest the burner (not shown) is larger than the pitch at point 56 nearest the gas exit port (not shown).

Referring again to FIG. 2, and in the preferred embodiment depicted therein, ceramic insert 44 is an integral assembly. In another embodiment, not shown, such assembly 44 could comprise two or more segments contiguous with each other. Thus, by way of illustration and not limitation, one could have such contiguity at point 60 between two separate segments.

Figure 3:
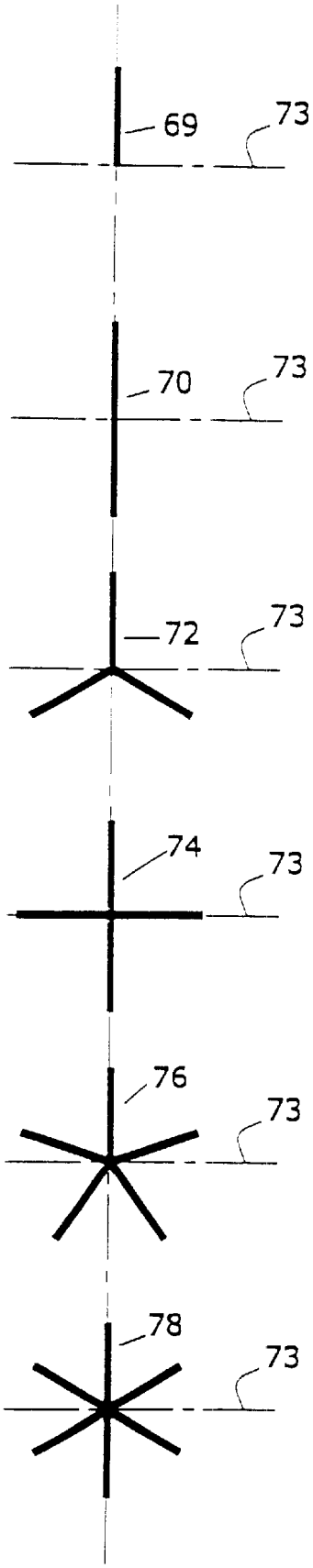
FIG. 3 is a schematic view of several suitable flame buster cross-sectional geometries.

Alternatively, or additionally, one may vary the heat dissipation properties of the radiant tube by utilizing ceramic inserts with different cross sectional shapes. Referring to FIG. 3, in which dotted lines 73 indicate the center lines of the inserts, one may use the substantially tape-like shape 69, the substantially tape-like shape 70, the three-winged cross-sectional shape 72, the four winged cross sectional shape 74, the five winged cross-sectional shape 76, and the six winged cross-sectional shape 78. The inserts made from shapes 69, 70, 72, 74, 76, and/or 78 may be helical along their length, or straight. In one embodiment, such inserts are helical along their length.

Referring again to FIG. 1, and in the preferred embodiment depicted therein, it is desirable to vary the heat transfer characteristics of the radiant tube assembly comprised of the radiant tube 10 and the insert 24 so that the temperature radiated by the assembly is substantially more uniform along its length. Without the use of a ceramic insert, as discussed elsewhere in this specification, the temperature within the tube 10 will vary as composition of the reaction mixture within the tube, and/or its temperature, varies; and, thus, the outer surface temperature of the tube 10 also will vary. The inventions described in this specification tend to minimize the changes in the outer surface temperature of the tube 10 from one end to the other.

One means of varying the changes in such outer surface temperature is to vary to heat transfer characteristics of the insert within the tube 10, from one point to another. One means of doing so is illustrated in FIG. 2, wherein the pitch and pitch angle of the insert are varied from one end to another. Another means of doing so is illustrated in FIG. 3, wherein the surface area of the insert is varied. As "wings" are added to the insert, the surface area of the insert increases, and the heat transfer characteristics increase. Referring to FIG. 3, the "wing" portion is the portion denoted by a solid line extending outwardly from the centerpoint.

Figure 4:
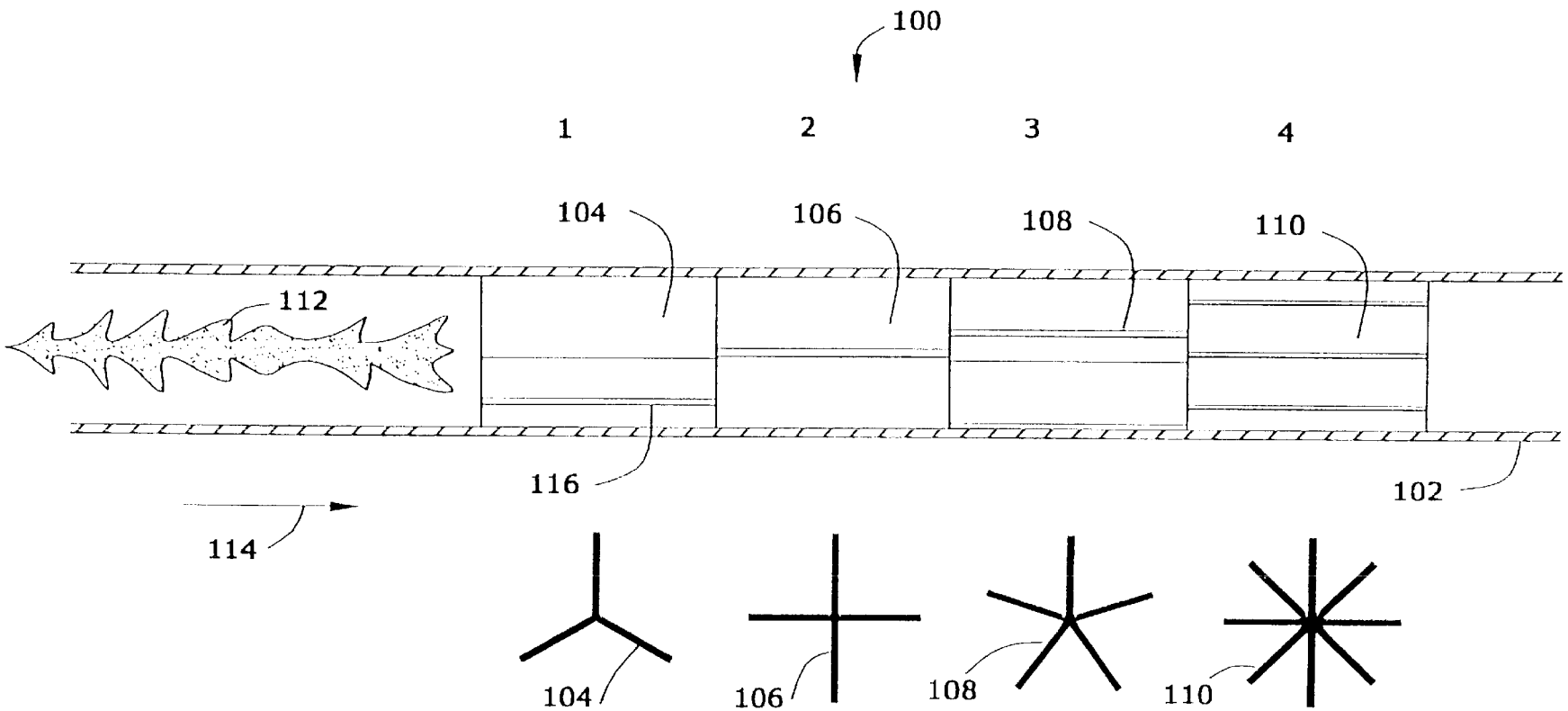
FIG. 4 is a schematic representation of the use of several different flame busters within a radiant tube.

FIG. 4 illustrates an assembly 100 comprised of a radiant tube 102 in which are disposed ceramic inserts 104, 106, 108, and 110; in the embodiment depicted, tube 102 is linear. However, as will be apparent to those skilled in the art, it also may be arcuate, bent, U-shaped, etc.

In the embodiment depicted, ceramic insert 104 is comprised of three wings, ceramic insert 106 is comprised of four wings, ceramic insert 108 is comprised of/ five wings, and ceramic insert 110 is comprised of eight wings. In this embodiment, inserts 104, 106, 108, and 110 are substantially contiguous with each other. In another embodiment, not shown, a ceramic insert with two wings is disposed in front of ceramic insert 104.

In another embodiment, not shown, in addition to the number of wing in adjacent insert sections, or instead of varying such wings, one may vary either the helix angle or pitch in adjacent sections.

Referring again to FIG. 4, the air/gas mixture 112 is combusted in a burner (not shown) and travels in the direction of arrow 114 down tube 102. At a certain point 116 the flame caused by the combustion of mixture 112 ceases to exist. In general, the temperature of mixture 112 decreases as it travels in the direction of arrow 114, for more and more of its heat is lost.

Thus, when the air gas mixture 112 contacts insert 104, it is relatively hot; the insert 104, because it has a relatively low surface area, has a relatively low rate of heat transfer to the inner surface of tube 102.

When the air gas mixture 112 contacts insert 106, it is cooler than when it contacted insert 104; thus insert 106 is designed a higher surface area in order to provide a higher rate of heat transfer than that provided by insert 104; the goal is, by balancing these variables, to maintain the outer surface of tube 102 at substantially the same temperature.

Another means of varying the heat transfer characteristics of the radiant tube assembly is by utilizing discontinuous insert segments, i.e., segments which are not contiguous with each other. Such an arrangement is illustrated in FIG. 1, wherein the section 120 of the tube 10 contains no ceramic insert, but the section 122 of the tube 10 does contain such an insert. Other such arrangements, which tend to vary the heat transfer characteristics within the radiant tube from one end of the radiant tube to the other, will be apparent to those skilled in the art.

Referring again to FIG. 1, and in the preferred embodiment depicted therein, radiant tube 10 is substantially linear. In another embodiment, not shown, the radiant tube 10 will be substantially arcuate, being substantially U-shaped or W-shaped. In another embodiment, not shown, the radiant tube 10 will have both linear and arcuate portions.

In one embodiment, not shown, the radiant tube 10 has two straight legs connected to an arcuate elbow. This type of radiant tube is often referred to as a U-type tube.

By way of further illustration, one may use a W-tube with four legs and three elbows, which is also comprised of linear and arcuate sections.

It is preferred to use the ceramic insert of this invention in those portions of the radiant tubes closest to the exhaust; for, in such portions, the combustion mixture will generally be at a lower temperature than it is in the portions nearer the burner.

Figure 5:
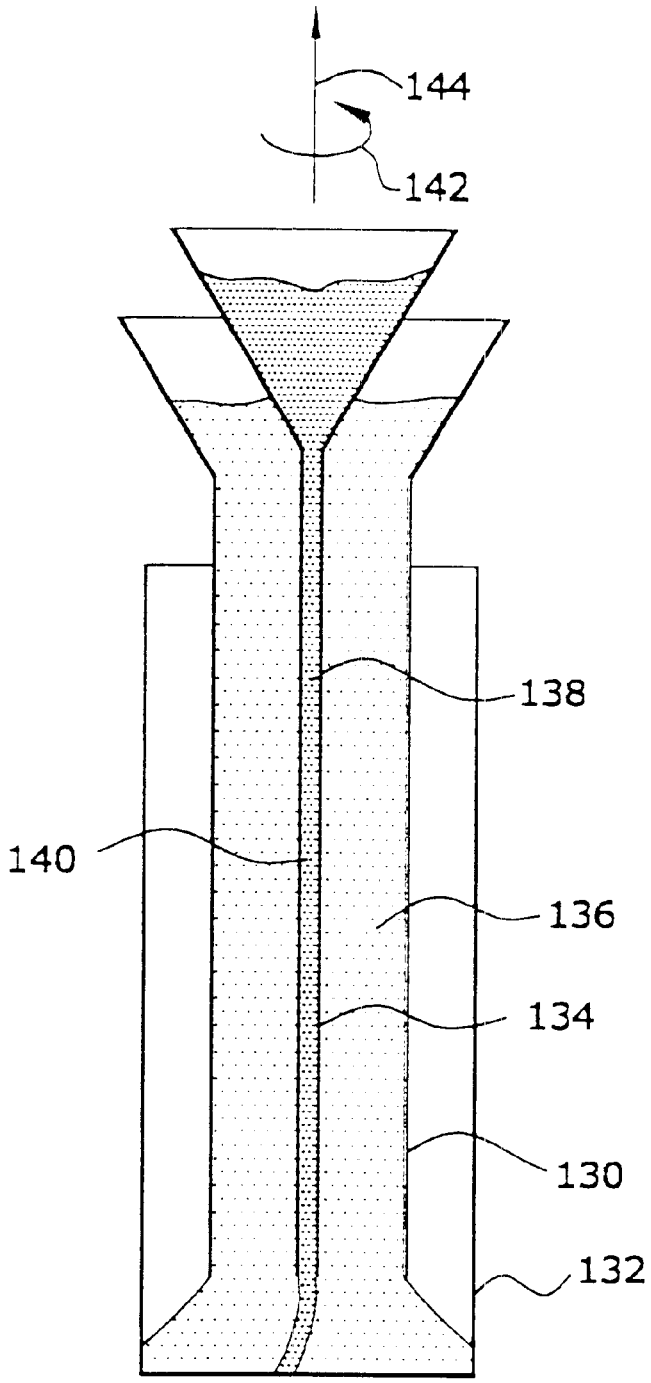
FIGS. 5 and 6 are schematics of one preferred means for making the flame buster of the invention.

FIG. 5 is a flow diagram of one preferred process for making an ceramic insert. The process described in this flow diagram involves the use of silicon carbide grains; however, it will be apparent that the process is also useful with other ceramic materials.

Figure 6:
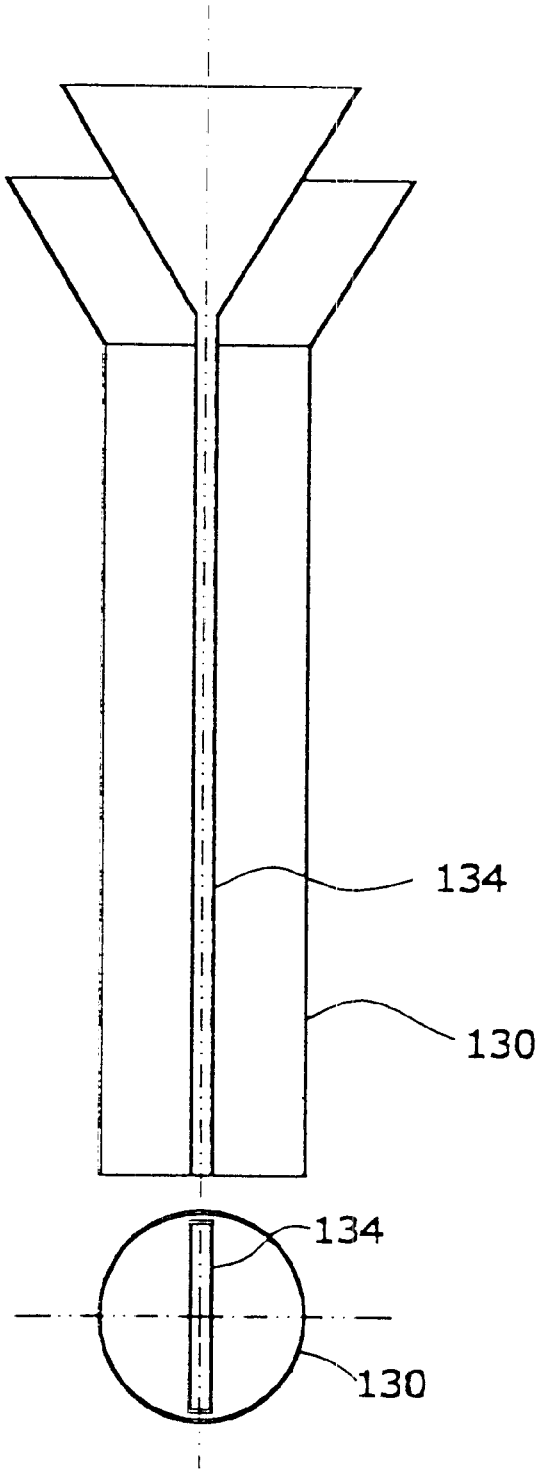

Referring to FIG. 5, and in the preferred embodiment depicted therein, a round funnel 130 is disposed within a vertical closed bottom aluminum tube 132. Thereafter, an inside flat blade forming funnel is disposed within the funnel 132. The tube 132, the funnel 130, and the funnel 134 are attached to each other by conventional means (such as screws) in order to maintain them in fixed spatial relationship vis-a-vis each other. The spatial relationship of funnels 130 and 134 are also illustrated in FIG. 6.

Referring again to FIG. 5, funnel 130 is filled with silicon carbide grains. It is preferred that at least about 99 weight percent of the silicon carbide grains have an average particle size of from about 50 to about 1000 microns and, more preferably, of from about 150 to about 250 microns. In one embodiment, substantially all of the silicon carbide grains have an average particle size of from about 160 to about 220 microns.

For the silicon carbide grains described above, the desired particle size ranges facilitate the pourability of the powder. It will be apparent that, when other powders are used for form the ceramic material, different particle size ranges may be desirable.

Referring again to FIG. 5, the silicon carbide grains 136 are preferably poured into funnel 130 until the grains reach near the top of such funnel. Thereafter, a mixture 138 comprised of such silicon carbide grains 136 and resin are poured into funnel 134.

A relatively small amount of such resin (from about 1.5 to about 5 weight percent, weight of dry powdered resin by total weight of resin and silicon carbide) is used. The resin is used as a binder which will afford structural integrity to the tape formed within funnel neck 140.

In one embodiment, the resin used is a dry powdered phenolic resin sold as "Durez 29-302" by the Occidental Chemical Corporation (Durez Division) of Niagara Falls, N.Y.

Once both of the funnels 130 and 134 have been filled with grains, the funnel 134/funnel 130 assembly is simultaneously rotated in the direction of arrow 142 while being pulled upwardly in the direction of arrow 144. Varying the rate of rotation for a given lift rate will vary the pitch on the helix being formed by the process.

It will be appreciated that, if the funnel 134/funnel 130 assembly is lifted without being rotated, a straight extruded blade will be formed. If the funnel is lifted while being rotated in one direction and then in another direction, a tape with reversing helical portions will be formed. If a funnel 134 is used with a cross section different than the rectangular cross section depicted in FIG. 5, the helical tape formed will have such different cross section (see FIG. 3). Reference may be had to applicant's U.S. Pat. Nos. 5,655,599, 5,071,685, and 4,789,506 for a discussion of other aspects of and uses for this process; the entire disclosure of each of these United States patents is hereby incorporated by reference into this specification.

The funnel 134/funnel 130 assembly may be turned by conventional means, such as by means of a cam follower.

Inasmuch as funnels 130 and 134 are attached to each other, the twisting and raising of funnel 134 also twists and raises funnel 130. The removal of the 130/134 funnel assembly leaves the formed helical tape within a bed of loose grains of silicon carbide, both of which are disposed within container 132. Thereafter, container 132 with the helical tape therein and the loose silicon carbide is transported to an oven (not shown) where it is heated to a temperature of from about 350 to about 450 degrees Fahrenheit to set the resin particles and afford structural integrity to the helical tape.

After heating, the formed helical tape is removed from the bed of silicon carbide particles. The tape as formed is then treated to transform the resin while maintaining the structural integrity of tape.

One such transformation process involves contacting the tape with molten silicon, which infiltrates and/or wicks into the body of the tape, converts the resin to elemental carbon, and thereafter converts the elemental carbon into secondary silicon carbide. It is preferred to contact the tape with the molten silicon in a vacuum chamber and/or an inert gas atmosphere to prevent oxidation of the resin (which would form carbon dioxide and remove the support from the silicon carbide grains) while subjecting the tape and the silicon to a temperature of from about 1,500 to about 1,900 degrees Celsius for a period of less than about 15 minutes.

The infiltrated tape thus formed is allowed to cool. Thereafter it is ready to use in the structure depicted in FIG. 1.

It will be appreciated that the helical tape may be treated to form other silicon infiltrated materials besides the one discussed above. Thus, e.g., one could use a graphite grain, or amorphous carbon grain, rather than the silicon carbide grain.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An integral ceramic insert for a radiant tube, wherein said integral ceramic insert has a substantially helical shape, and wherein:

(a) said integral ceramic insert is comprised of at least 40 volume percent of a material selected from the group consisting of silicon, silicon carbide, silicon nitride, and mixtures thereof, (b) said integral ceramic insert has a thermal expansion rate of less than $6.0\times10^{-6}$ meters/meter/degree Celsius, (c) said integral ceramic insert has a thermal conductivity, at a temperature of 25 degrees Celsius, of at least 0.2 calories/centimeter/second/degree Celsius, (d) said integral ceramic insert has a diameter of from about 2 to about 10 inches and a length such that the ratio of said length to said diameter of said integral ceramic insert is from about 2/1 to about 8/1, (e) said helical shape is comprised of one or more pitches of from about 2 to about 32 inches, each which defines a helix angle of from about 15 to about 80 degrees, provided that there is from about 0.5 to about 8 inches of pitch per inch of diameter of the integral ceramic insert, and (f) said ceramic insert has a cross-sectional shape defined by a centerpoint and extending radially outwardly therefrom at least one wing.

2. The integral ceramic insert as recited in claim 1, wherein said ceramic insert is comprised of at least 40 volume percent of silicon carbide.

3. The integral ceramic insert as recited in claim 1, wherein said integral ceramic insert is comprised of at least 40 volume percent of silicon nitride.

4. The integral ceramic insert as recited in claim 1, wherein said integral ceramic insert has a thermal conductivity of at least about 0.3 calories/centimeter/second/degree Celsius.

5. The integral ceramic insert as recited in claim 4, wherein said integral ceramic pitch is comprised of a first end and a second end, and wherein said pitch of said ceramic insert varies from said first end to said second end.

6. The integral ceramic insert as recited in claim 4, wherein said helix angle is from about 40 to about 80 degrees.

7. The integral ceramic insert as recited in claim 6, wherein said helix angle is from about 60 to about 80 degrees.

8. The integral ceramic insert as recited in claim 6, wherein said ceramic insert has a cross-sectional shape defined by a centerpoint and extending radially outwardly therefrom at least three wings.

9. The integral ceramic insert as recited in claim 6, wherein said ceramic insert has a cross-sectional shape defined by a centerpoint and extending radially outwardly therefrom at least five wings.

10. A radiant tube comprised of a first integral ceramic insert disposed inside of said tube, wherein said integral ceramic insert has a substantially helical shape, and wherein:

(a) said first integral ceramic insert is comprised of at least 40 volume percent of a material selected from the group consisting of silicon, silicon carbide, silicon nitride, and mixtures thereof, (b) said first integral ceramic insert has a thermal expansion rate of less than $6.0\times10^{-6}$ meters/meter/degree Celsius, (c) said first integral ceramic insert has a thermal conductivity, at a temperature of 25 degrees Celsius, of at least 0.2 calories/centimeter/second/degree Celsius, (d) said first integral ceramic insert has a diameter of from about 2 to about 10 inches and a length such that the ratio of said length to said diameter of said integral ceramic insert is from about 2/1 to about 8/1, (e) said helical shape is comprised of one or more pitches of from about 2 to about 32 inches, each which defines a helix angle of from about 15 to about 80 degrees, provided that there is from about 0.5 to about 8 inches of pitch per inch of diameter of the integral ceramic insert, and (f) said ceramic insert has a cross-sectional shape defined by a centerpoint and extending radially outwardly therefrom at least one wing.

11. The radiant tube as recited in claim 10, wherein said radiant tube further comprises a second integral ceramic insert disposed within said tube, wherein said second integral ceramic insert has a substantially helical shape, and wherein:

(a) said second integral ceramic insert is comprised of at least 40 volume percent of a material selected from the group consisting of silicon, silicon carbide, silicon nitride, and mixtures thereof, (b) said second integral ceramic insert has a thermal expansion rate of less than $6.0\times10^{-6}$ meters/meter/degree Celsius, (c) said second integral ceramic insert has a thermal conductivity, at a temperature of 25 degrees Celsius, of at least 0.2 calories/centimeter/second/degree Celsius, (d) said second integral ceramic insert has a diameter of from about 2 to about 10 inches and a length such that the ratio of said length to said diameter of said second integral ceramic insert is from about 2/1 to about 8/1, and (e) said helical shape is comprised of one or more pitches of from about 2 to about 32 inches, each which defines a helix angle of from about 15 to about 80 degrees, provided that there is from about 0.5 to about 8 inches of pitch per inch of diameter of said second integral ceramic insert.

12. The radiant tube as recited in claim 11, wherein the thermal expansion rate of said first integral ceramic insert differs from the thermal expansion rate of said second integral ceramic insert.

13. The radiant tube as recited in claim 11, wherein the thermal conductivity of said first integral ceramic insert differs from the thermal conductivity of said second integral ceramic insert.

14. The radiant tube as recited in claim 11, wherein said ratio of said length to said diameter of said first integral ceramic insert differs from said ratio of said length to said diameter of said second integral ceramic insert.

15. The radiant tube as recited in claim 11, wherein said ratio of said pitch per inch of said diameter of said first integral ceramic insert differs from said ratio of said pitch per inch of said diameter of said second integral ceramic insert.

* * * * *